US006033293A

United States Patent [19]

Crevasse et al.

[11] Patent Number: 6,033,293

[45] Date of Patent: Mar. 7, 2000

[54] APPARATUS FOR PERFORMING CHEMICAL-MECHANICAL POLISHING

[75] Inventors: Annette Margaret Crevasse, Orlando, N.J.; Alvaro Maury, Orlando, Fla.; Sanjay Patel, New Providence; John Thomas Sowell, Orlando, both of N.J.

[73] Assignee: Lucent Technologies Inc., Murray Hill, N.J.

[21] Appl. No.: 08/947,178

[22] Filed: Oct. 8, 1997

[51] Int. Cl.[7] ..... B24D 9/10

[52] U.S. Cl. ..... 451/494; 451/285; 451/286; 451/287; 451/288; 451/290; 451/550; 451/494

[58] Field of Search ..... 451/285, 286, 451/287, 288, 290, 550, 494

[56] References Cited

U.S. PATENT DOCUMENTS

| | | | |
|---|---|---|---|
| 5,584,746 | 12/1996 | Tanaka et al. | 451/41 |
| 5,704,827 | 1/1998 | Nishi et al. | 451/285 |
| 5,853,317 | 12/1998 | Yamamoto | 451/288 |

*Primary Examiner*—David A. Scherbel
*Assistant Examiner*—Shantese McDonald

[57] ABSTRACT

An apparatus and method for performing chemical-mechanical polishing is disclosed in which the pad is secured to the platen without the use of adhesives. A polishing pad and a platen are secured together by a releasable attractive force; the force may comprise a vacuum or electromagnetic force, and the pad has a hard or magnetic backside layer for facing the plating and responding to the attractive force. This invention has particular application to chemical-mechanical polishing for use in planarizing dielectrics.

10 Claims, 4 Drawing Sheets

APPARATUS FOR PERFORMING CHEMICAL-MECHANICAL POLISHING

FIELD OF THE INVENTION

The present invention relates to an apparatus and method for performing chemical-mechanical polishing and, more particularly, to an apparatus and method for chemical-mechanical polishing involving a polishing pad and a platen secured together by a releasable attractive force. This invention has particular application to chemical-mechanical polishing for use in planarizing dielectrics.

BACKGROUND OF THE INVENTION

Chemical-mechanical polishing generally involves pressing a substrate against a wetted, polishing platen within a polisher apparatus, with the conditions being controlled as to the temperature, pressure, and chemical environment. In a typical chemical-mechanical polishing ("CMP") apparatus, a pad is glued onto a circular metal platen in the polisher. The CMP pad is usually about twenty to thirty inches in diameter and 100 mils in thickness, depending on the application. The pads are customarily formed of a relatively soft material, such as polyurethane. The substrate to be planarized is placed on a carrier and then pressed against the pad while both the pad and substrate rotate, as a polishing slurry is applied. The polishing slurry often is comprised of abrasive materials (i.e., silica, alumina, or ceria), suspended in water, with additives to obtain a specific pH and create oxide layers on the materials to be polished that can be abraded easily by the particles. In some applications, such as those involving a silicon substrate or metal polishing, the friction between the substrate and the pad can generate a significant amount of heat.

For example, FIG. 1 illustrates a pad and platen as used in a typical CMP polisher apparatus. As shown in FIG. 1, a CMP apparatus comprises a pad 10 and a platen 12; a layer of adhesive 14 secures the pad to the platen when they are pressed together following the arrows A. The substrate 16 to be planarized is secured to a carrier 18. The carrier 18 may include a vacuum (not shown) for holding the substrate to the carrier during the load and unload steps. While polishing, however, the vacuum is normally deactivated, and the substrate 16 is held in place by the high coefficient of friction between the carrier 18 and the substrate 16. Also, the carrier may be conformed (e.g., with use of a polymer sheet or wax) to receive the substrate 16, and it may be adapted to receive a plurality of substrates to be planarized simultaneously. In operation, a polishing slurry 20 is placed over the pad 10, and the carrier 18 presses the substrate 16 against the pad following the arrow B. The carrier 18 and/or the platen 12 may rotate the substrate on the pad, or vibrate or oscillate, as illustrated by the arrows R. As the whetted pad 10 is pressed against and moved across the surface of the substrate 16, the surface of the substrate is polished by chemical and mechanical means, the aim being to remove metal layers or achieve a smooth and uniform surface.

This CMP process has become the process of choice for planarizing interlevel dielectric layers, particularly as circuit densities have increased. A major issue in planarizing the layers involves achieving a substrate surface that is completely smooth and uniform. Often, irregular or wavy surfaces may be formed on the substrate, occurring at the microlevel and having a negative impact on the productivity and reliability of the integrated-circuit devices. Much effort has been applied to developing improved CMP methods for efficiently obtaining a uniform planarized surface. Efforts have been made, for example, to develop new materials and apparatuses for the parts that are directly adjacent to or impact upon the substrate surface, that is, the carrier, the slurry, the pad, or the substrate itself. See, for example, U.S. Pat. No. 5,643,053, to Shendon issued Jul. 1, 1997, entitled "Chemical Mechanical Apparatus with Improved Polishing Control" (addressing the carrier); U.S. Pat. No. 5,609,719, to Hempel issued Mar. 11, 1997, entitled "Method for Performing Chemical Mechanical Polish (CMP) of a Wafer" (addressing the pad and its ability to retain slurry); U.S. Pat. No. 5,514,245 to Doan et al., issued May 7, 1996, entitled "Method for Chemical Planarization of A Semiconductor Wafer to Provide A Planar Surface Free of Microscratches" (addressing the pad composition); and U.S. Pat. No. 5,449,314 to Meikle et al., entitled "Method of Chimical [sic] Mechanical Polishing for Dielectric Layers" (addressing the composition of the substrate itself).

The instant invention provides an improved apparatus and method in which difficulties with the CMP process are addressed through parts that are not directly adjacent to the substrate surface. Further advantages of this invention should appear more fully upon consideration of the detailed description given below.

SUMMARY OF THE INVENTION

Summarily described, the invention embraces an apparatus for chemical-mechanical polishing wherein the pad and platen are secured together by a releasable attractive force, and the pad has a backside layer adapted to respond to the attractive force. The attractive force may comprise a vacuum force or electromagnetic force, and the force can be activated or deactivated via a switch. In the embodiment comprising the vacuum force, the platen is perforated, having a plurality of holes opening to its major surface, and it is coupled to a vaccum source for securing the pad to the platen; the backside of the pad comprises a thin layer of a hard material, preferably plastic or metal. In the embodiment comprising the electromagnetic force, the backside layer of the pad comprises a thin layer of magnetic material, and one or more electromagnets are incorporated into the platen. The invention further involves a method for performing this CMP process.

BRIEF DESCRIPTION OF THE DRAWINGS

For a better understanding of the invention, an exemplary embodiment is described below, considered together with the accompanying drawings, in which.

It is to be understood that these drawings are for the purposes of illustrating the concepts of the present invention and are not to scale.

DETAILED DESCRIPTION OF THE INVENTION

Applicants have discovered that the use of adhesives is a cause of difficulties or inefficiencies with the CMP process.

Figure 1:
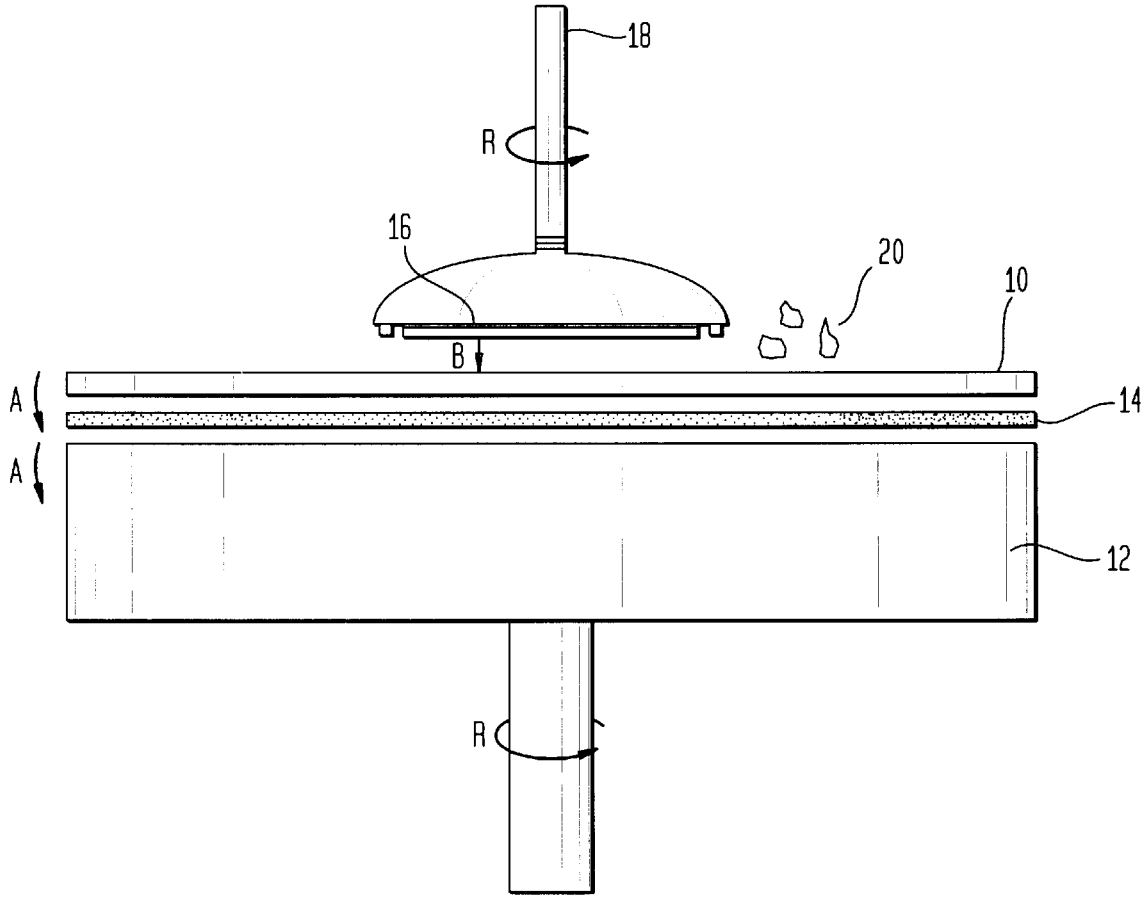
FIG. 1 (PRIOR ART)
FIG. 1 is a cross-sectional side view of a prior art pad and platen for use in a CMP polisher apparatus.

With prior art CMP processes, the pad is typically secured to the platen by use of a film of a pressure-sensitive adhesive disposed between them (e.g., layer 14 in FIG. 1). It has been discovered that the use of adhesives is problematic in many ways. Initially, in light of the pressure and high temperature generated with some processes, it is necessary that the properties of the adhesive be carefully maintained by the pad manufacturers. This interjects inefficiencies and complications in the process.

Also, it is generally necessary that the pad be manually removable for frequent replacement, as the pad wears out after polishing a certain number of wafers (anywhere from 100 to around 700), and it needs to be continuously conditioned (or abraded), to maintain a high and stable polishing rate. Especially in high-volume manufacturing, the removability of the pads becomes a problem because in such cases the pads may need to be replaced on a daily basis. However, to ensure the integrity of the polishing process, it is necessary that the pad be firmly secured on the platen while the process is being carried out. With adhesives, it is difficult to obtain a secure bond between the pad and platen that can withstand the high temperatures, high pressures, and chemically-reactive environment of the polishing process, but that also provides a readily-reversible bond so the pads can be removed or exchanged without excessive effort. Consequently, operators of CMP apparatuses have had to exert force in seeking to manually remove the pads from their platens to overcome the adhesive bond, which can be strenuous and inefficient.

It also has been discovered that, with the use of adhesives, air pockets may become trapped between the pad and platen. These air pockets, it has been found, negatively impact upon the uniformity of the polishing. Especially considering the high pressures involved in the process and the soft material typically used in fabricating the pad, these air pockets can cause defects or perturbations in the wafer or substrate surface, disrupting the uniformity of the polishing process. Another problem involved with adhesives is a lack of consistency in the adhesive properties from pad to pad; that is, in some cases a certain batch of pads may not glue properly to the platens. In such cases, the defective batch of pads may come loose after being used to polish only a small number of wafers, thereby creating inefficiencies. Yet another problem with adhesives is that the residue build up on the platen can only be removed in some cases with highly flammable solvents (e.g., acetone), creating a fire hazard.

It therefore is desirable to provide a CMP apparatus and process that avoids the use of adhesives. The instant invention provides an improved apparatus for firmly securing the pad to the platen of the chemical-mechanical polishing apparatus. Referring to the drawings, FIG. 1 shows a prior art pad and platen for use in a CMP polisher apparatus, which has been previously described. Since the invention addresses the manner in which the pad is secured to the platen, the type of wafer or substrate 16 or type of carrier 18 used are not critical to this invention and thus are shown in FIGS. 2 and 3 for illustrative purposes, that is, to show operation of the invention.

Figure 2:
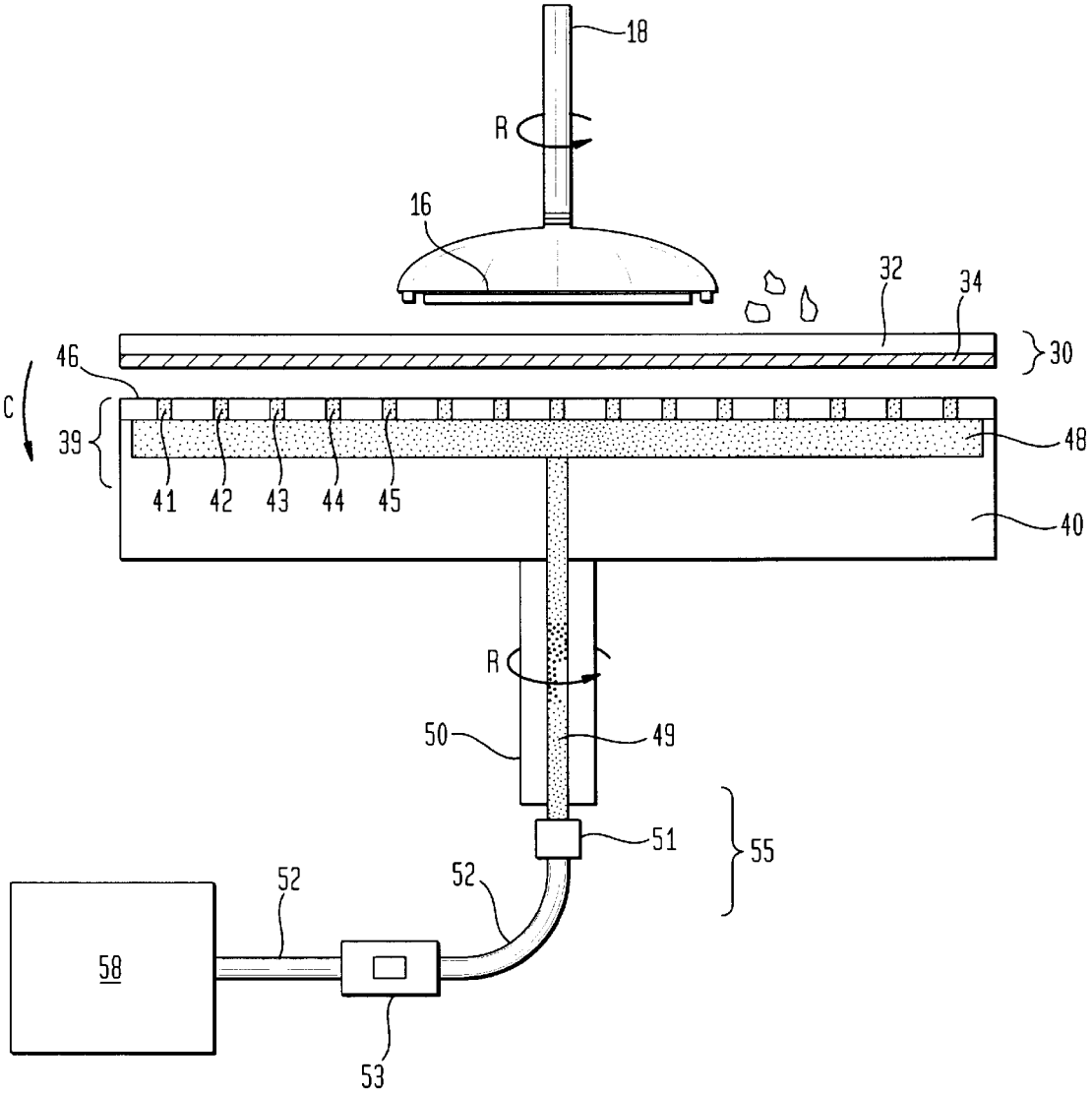
FIG. 2 is a cross-sectional side view of one embodiment of the inventive apparatus involving use of a vacuum force.
Figure 3:
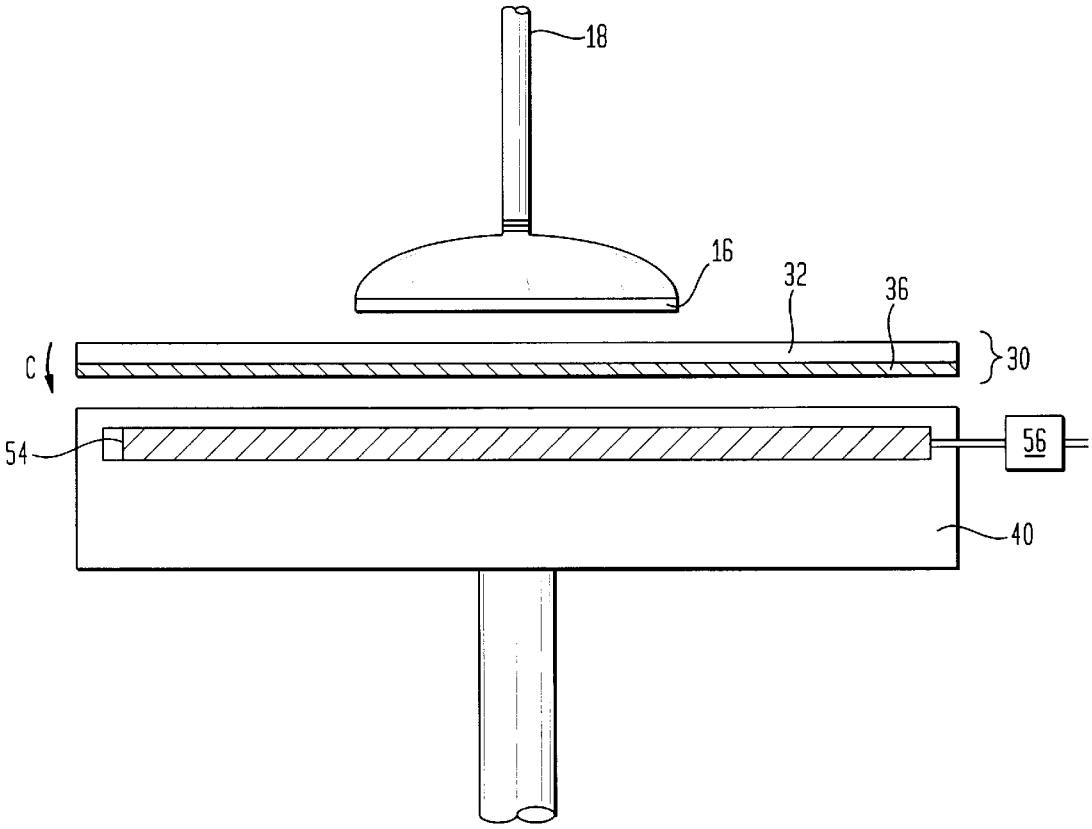
FIG. 3 is a cross-sectional side view of one embodiment of the inventive apparatus involving use of an electromagnetic force.

Referring to FIG. 2, there is shown one embodiment of the inventive apparatus. The pad 30 has an upper layer 32 for contacting the wafer 16 and a backside layer 34 which faces the platen 40 when the pad and platen are secured together following the arrow C. The upper layer 32 may be fabricated with any materials known in the art for fabricating CMP pads. The backside layer 34 is comprised of a hard material having low compressibility, preferably plastic or metal. An advantageous material to be used for fabricating the backside layer 34, for example, includes the polymeric material sold under the tradename MYLAR®. Preferably, the backside layer 34 is approximately 5–20 mils thick.

Figure 2A:
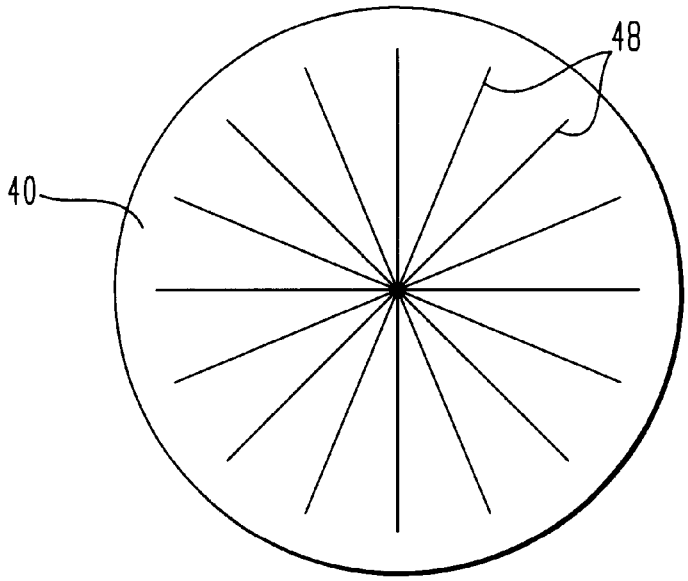
FIG. 2A shows a top view of the polishing platen (bottom plate) used in the embodiment shown in FIG. 2.
Figure 2B:
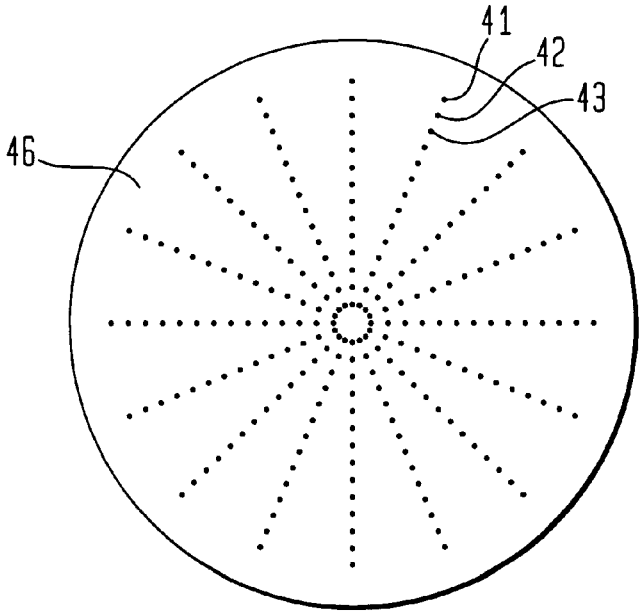
FIG. 2B shows a plan view of the top plate used in the embodiment shown in FIG. 2.

Referring still to FIG. 2, the platen 40 has a polishing table 39 which is comprised of a top plate 46 and a bottom or lower plate 40. The top plate 46 is preferably comprised of metal; it is perforated, that is, it has a plurality of small diameter holes traversing its width, i.e., 41, 42, 43, 44, 45, and so forth, that open to the top or major surface of the top plate 46. The bottom plate 40 has vacuum channels 48 running radially outward from the center of the plate, as also can be seen in FIG. 2A. Looking at FIGS. 2A and 2B, the holes are placed in the top plate 46 so that they will align with vacuum channels 48, when the two plates are placed adjacent each other.

Referring now to FIG. 2, the channels 48 are coupled to a vacuum source 55. The vacuum source comprises a vacuum line 49, which runs inside a rotating shaft 50 supporting the platen 40, as well as a vacuum seal 51, a vacuum hose 52, and a vacuum switch 53. The vacuum line 49 is coupled to the vacuum hose 52. The vacuum seal 51 is placed over the connection between the vacuum line 49 and vacuum hose 52. The vacuum switch 53, is coupled to the vacuum hose 52 for turning the vacuum on and off. The vacuum hose 52 is then coupled to a vacuum 58.

Figure 2C:
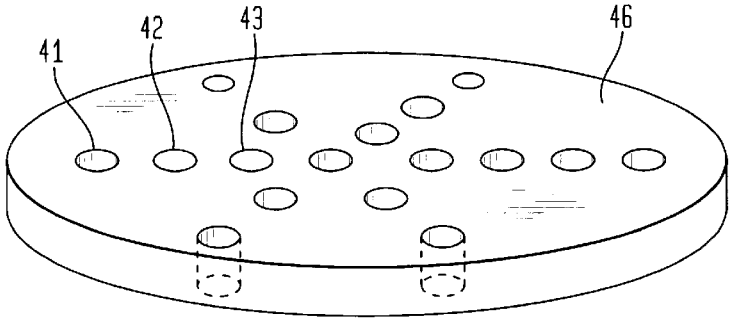
FIG. 2C shows a three-dimensional view of the top plate shown in FIGS. 2 and 2B.

FIG. 2C shows a three-dimensional view of the top plate 46 with the vacuum holes. When a polishing table of 32 inches in diameter is used, the top plate can be about 0.25–0.50 inches in thickness. The top plate 46 can be fabricated with a high strength, low thermal expansion metal. It is advantageous to provide holes 41, 42, 43, etc., having a diameter of about 2 millimeters and covering about 2% of the surface area of the platen 46. For example, for a platen having a diameter of 32 inches, holes ranging in number from 2000 to 3000 have proved advantageous. However, there are many ways in the hole patterns could be arranged. Different layouts, numbers of holes, and hole sizes are contemplated, although the hole pattern used may affect the holding force of the vacuum source and the uniformity of force distributed across the pad.

In operation, the pad 30 is positioned on the perforated platen, with its hard backside layer 34 facing the platen; the pad 30 and platen 40 are placed together, following the arrow C. Once the desired position of the pad relative to the platen is achieved, the vacuum source 55 is turned on or activated, thus exerting an attractive force on the pad; that is, the vacuum source suctions the pad toward the platen and secures the pad thereon. The backside layer 34 of the pad responds to the vacuum force by exerting a contact force on the upper surface of the platen 46. The hard backside layer 34 also serves to protect the upper layer 32 of the pad from the suctioning power of the vacuum source 55. An advantageous vacuum level is less than $2\times10^{-3}$ psi (1 Torr), which will hold the pad firmly in place during the CMP process when a platen having holes as previously described is used. It is understood, however, that the desired vacuum level may change depending upon the number and diameter of the holes in the platen, and vice versa. Once the CMP process is completed, the vacuum can be turned off using the switch 53, and the operator can easily remove the pad 30 from the polishing table 39.

Referring to FIG. 3, there is shown an alternate embodiment of the invention. The platen 30 again has an upper layer 32 and a backside layer 36; here, the backside layer 36 is comprised of a magnetic material. For example, a suitable material for fabricating the backside layer 36 includes a thin steel sheet. The platen 40 has an electromagnet 54 or alternatively a plurality of electromagnets (not shown), incorporated within it. The electromagnet 54 (or each of the plurality of electromagnets) is coupled to a switch 56 for activating or deactivating the electromagnetic force exerted by the electromagnet. In operation, the pad 30 is placed on the platen 40, with its magnetic backside layer 36 facing the platen; the pad 30 and platen 40 are placed together, following the arrow C. Once the desired position of the pad relative to the platen is achieved, the electromagnet is turned on, thus exerting an attractive force on the magnetic backside layer 36; the magnetic backside layer 36 is pulled toward the platen, and exerts a corresponding force on the platen, thus securing the pad thereon. Once the CMP process is completed, the electromagnet(s) can be turned off using the switch 56, and the operator can easily remove the pad 30 from the platen 40.

It will be understood that the embodiments described herein are merely exemplary and that a person skilled in the art may make variations and modifications without departing from the spirit and scope of the invention. All such variations and modifications are intended to be included within the scope of the appended claims.

We claim:

1. An apparatus for performing chemical-mechanical polishing of a substrate comprising:

a polishing pad adapted to receive the substrate thereon and a platen having a major surface adapted to receive the polishing pad thereon;

a source of a releasable attractive force adapted to pull the pad in the direction of the platen, the pad having an upper layer for contacting the substrate and a backside layer for facing the major surface of the platen and responding to the attractive force, wherein the source of the attractive force comprises an electromagnet and the backside layer is comprised of a magnetic material.

2. The apparatus of claim 1, wherein the source of the attractive force comprises a plurality of electromagnets disposed within the platen.

3. An apparatus for performing chemical-mechanical polishing of a substrate comprising:

a polishing turntable having vacuum channels therein;

a detachable polishing platen having a major planar surface and a plurality of holes traversing its width opening to the major planar surface, the holes and the vacuum channels being so oriented relative to each other that they are aligned when the polishing platen is disposed on the polishing turntable;

a substantially planar polishing pad wherein the pad is adapted to be releasably disposed on the platen and the substrate pressed against the pad, the polishing pad having a hard backside layer facing the platen and an upper layer for contacting the substrate; and a vacuum source opening to the vacuum channels and the plurality of holes in the polishing platen so that the suctioning force of the vacuum source can reach the major surface of the polishing platen and suction the pad toward the platen.

4. The apparatus according to claim 3, wherein the vacuum source is coupled to a switch for activating and deactivating the vacuum force so that the pad can be selectively secured onto and removed from the platen.

5. The apparatus according to claim 3, wherein the platen comprises a top plate facing the pad and a bottom plate, the top plate having a plurality of perforations and the bottom plate having a plurality of vacuum channels, the vacuum channels being disposed to align with the perforations of the top plate.

6. The apparatus according to claim 5, wherein the vacuum source comprises a vacuum and a vacuum line, and the vacuum line opens to the vacuum channels and couples the vacuum channels to the vacuum.

7. An improved apparatus for performing chemical-mechanical polishing of the type where a pad is secured to a platen and a substrate is pressed against the pad, the improvement comprising:

the pad having a magnetic backside layer for contacting the platen; and the platen having an electromagnet disposed within it for attracting the magnetic backside layer of the pad.

8. The apparatus of claim 7, wherein the electromagnet is coupled to a switch for activating or deactivating its electromagnetic force so that the pad can be selectively secured to and detached from the platen.

9. The apparatus according to claim 8, further comprising a plurality of electromagnets disposed within the platen, each of the plurality of electromagnets being coupled to the switch.

10. The apparatus of claim 7, wherein the backside layer is fabricated with steel.

* * * * *